US008040287B2

(12) United States Patent
Kimura

(10) Patent No.: US 8,040,287 B2
(45) Date of Patent: Oct. 18, 2011

(54) RADIO WAVE RECEIVING DEVICE WITH MAGNETIC DRIVE UNIT AND ANTENNA STRUCTURE AND ELECTRONIC APPARATUS USING THE RADIO WAVE RECEIVING DEVICE

(75) Inventor: Soh Kimura, Kodaira (JP)

(73) Assignee: Casio Computer Co., Ltd., Tokyo (JP)

( * ) Notice: Subject to any disclaimer, the term of this patent is extended or adjusted under 35 U.S.C. 154(b) by 380 days.

(21) Appl. No.: 12/416,283

(22) Filed: Apr. 1, 2009

(65) Prior Publication Data

US 2009/0251997 A1 Oct. 8, 2009

(30) Foreign Application Priority Data

Apr. 2, 2008 (JP) ..... 2008-096086

(51) Int. Cl.
*H01Q 1/00* (2006.01)
*H01Q 1/12* (2006.01)

(52) U.S. Cl. ..... 343/787; 343/718; 343/702

(58) Field of Classification Search ..... 343/787, 343/788, 718, 702
See application file for complete search history.

(56) References Cited

U.S. PATENT DOCUMENTS

| | | | | |
|---|---|---|---|---|
| 7,433,273 | B2 | 10/2008 | Oguchi et al. | |
| 7,701,806 | B2 | 4/2010 | Oguchi et al. | |
| 7,777,680 | B2 * | 8/2010 | Abe et al. | 343/718 |
| 2006/0066498 | A1 | 3/2006 | Abe et al. | |
| 2008/0080320 | A1 | 4/2008 | Abe et al. | |
| 2009/0207083 | A1 | 8/2009 | Miyazaki et al. | |
| 2010/0097895 | A1 | 4/2010 | Sumida et al. | |

FOREIGN PATENT DOCUMENTS

| | | | |
|---|---|---|---|
| EP | 1 455 249 | A2 | 9/2004 |
| EP | 1 906 270 | A2 | 4/2008 |
| EP | 2 009 518 | A1 | 12/2008 |
| EP | 2 133 761 | A1 | 12/2009 |
| JP | 62-55194 | U | 4/1987 |
| JP | 2004-286467 | A | 10/2004 |

(Continued)

OTHER PUBLICATIONS

Japanese Office Action dated Feb. 23, 2010 and English translation thereof issued in a counterpart Japanese Application No. 2008-096086.

Extended European Search Report dated Apr. 12, 2010 (in English) in counterpart European Application No. 09004600.4.

(Continued)

*Primary Examiner* — Hoang V Nguyen

(74) *Attorney, Agent, or Firm* — Holtz, Holtz, Goodman & Chick, P.C.

(57) ABSTRACT

A radio wave receiving device includes at least one magnetic drive unit and an antenna structure having a narrow core formed of magnetic material and a coil wound around the central part of the core. The device further includes two external magnetic members, each having a connecting part connected magnetically to one end part of the core. One magnetic member has a magnetism collecting part expanded in one side of the antenna structure from the connecting part to exclude the antenna structure, and the other magnetic member has a magnetism collecting part expanded in the other side of the antenna structure from the connecting part to exclude the antenna structure. These external magnetic members cover the drive unit in the both sides and shut off magnetic flux of external magnetic field from the both sides and collect magnetic flux of radio wave on the one end part of the core.

20 Claims, 8 Drawing Sheets

FOREIGN PATENT DOCUMENTS

| | | | |
|---|---|---|---|
| JP | 2004-294258 | A | 10/2004 |
| JP | 2004-354365 | A | 12/2004 |
| JP | 2006-343240 | A | 12/2006 |
| JP | 2007-232680 | A | 9/2007 |
| JP | 2007-286047 | A | 11/2007 |
| WO | WO 2007/108502 | A1 | 9/2007 |

OTHER PUBLICATIONS

Japanese Office Action dated Jun. 8, 2010 and English translation thereof, issued in counterpart Japanese Application No. 2008-096086.

* cited by examiner

RADIO WAVE RECEIVING DEVICE WITH MAGNETIC DRIVE UNIT AND ANTENNA STRUCTURE AND ELECTRONIC APPARATUS USING THE RADIO WAVE RECEIVING DEVICE

CROSS-REFERENCE TO RELATED APPLICATIONS

This application is based upon and claims the benefit of priority from prior Japanese Patent Application No. 2008-096086, filed Apr. 2, 2008, the entire contents of which are incorporated herein by reference.

BACKGROUND OF THE INVENTION

1. Field of the Invention

The present invention relates to a radio wave receiving device with a magnetic drive unit and an antenna structure, and an electronic apparatus using the radio wave receiving device.

2. Description of the Related Art

As a radio wave receiving device with a magnetic drive unit and an antenna structure, a time piece module incorporated in so-called radio wave controlled time piece can be exemplified.

The radio wave controlled time piece has been already known and is configured to receive standard radio wave containing time information so as to automatically correct a current time. The radio wave controlled time piece includes a time piece case including an accommodation space at least a part of which is opened, a time piece module accommodated in the accommodation space of the time piece case through the opening, a light transmission lid which covers the opening, a partition panel disposed in the accommodation space of the time piece case so as to partition the accommodation space between the time piece module and the light transmission lid, and at least one time indicating hand which is disposed between the light transmission lid and the partition panel within the accommodation space of the time piece case and driven by the time piece module to indicate a time on the partition panel.

The time piece module is one kind of electronic apparatuses, and includes a radio wave receiving device including a motor for driving the at least one time indicating hand and an antenna structure for receiving the standard radio wave including time information. The time piece module further includes an operation control circuit part which controls the operation of the motor so as to make the at least one time indicating hand indicate a current time on the partition panel and which drives the motor based on the time information contained in the standard radio wave received by the antenna structure so as to correct the current time indicated by the time indicating hand on the partition panel. Then, the motor is one kind of magnetic drive unit which is driven by magnetic force.

The antenna structure includes a narrow core formed of magnetic material such as amorphous metal, ferrite, permalloy and the like, and a coil wound around the central portion of the core.

The motor for the time piece module is required to be operated at a high precision and the antenna structure is required to have a high receiving sensitivity. To prevent the operation of the motor from being affected by external magnetic field, the time piece module is so configured that a side facing to the opening and the other side being opposite to the opening are covered with antimagnetic plates in the accommodation space of the time piece case because magnetic flux of the external magnetic field can enters into the accommodation space of the time piece case easily through the opening and its side opposing to the opening.

However, the antimagnetic plates reduce the receiving sensitivity of the antenna structure.

A structure which not only can guarantee the accuracy of the operation of the motor but also prevents the receiving sensitivity of the antenna structure from being lowered in the time piece module having the antimagnetic plates has been disclosed in, for example, Japanese Patent Application KOKAI Publication No. 2004-294258.

In this conventional structure, openings are formed in portions of the antimagnetic plates corresponding to the coil of the antenna structure of the time piece module.

The above-described conventional structure can prevent the receiving sensitivity of the antenna structure from lowering to some extent by using the antimagnetic plates, but a further improvement has been demanded.

The present invention has been derived under the above-described circumstances, and an object of the invention is to provide a radio wave receiving device with a magnetic drive unit and an antenna structure, which is capable of guaranteeing the precision of the operation of the magnetic drive unit against external magnetism and improving the receiving sensitivity of the antenna structure greatly more than conventional one.

BRIEF SUMMARY OF THE INVENTION

According to one aspect of the present invention, a radio wave receiving device comprises: at least one magnetic drive unit; an antenna structure which includes a narrow core formed of magnetic material and having both end parts and a central part between the both end parts, and a coil wound around the central part of the core; an external magnetic member which is formed of magnetic material, and which includes a magnetic connecting part connected magnetically to one of the both end parts of the core of the antenna structure and a magnetism collecting part expanded in one side of the antenna structure from the magnetic connecting part to exclude the antenna structure, the magnetism collecting part covering the at least one magnetic drive unit in the one side to shut off magnetic flux of external magnetic field from the one side and collecting magnetic flux of radio wave on the one end part of the core of the antenna structure; and another external magnetic member which is formed of magnetic material and which includes a magnetic connecting part connected magnetically to the one of the both end parts of the core of the antenna structure and a magnetism collecting part expanded in the other side of the antenna structure from the magnetic connecting part to exclude the antenna structure, the magnetism collecting part covering the at least one magnetic drive unit in the other side to shut off magnetic flux of external magnetic field from the other side and collecting magnetic flux of radio wave on the one end part of the core of the antenna structure.

According to another aspect of the present invention, a radio wave receiving device comprises: at least one magnetic drive unit; an antenna structure which includes a narrow core formed of magnetic material and having both end parts and a central part between the both end parts, and a coil wound around the central part of the core; an external magnetic member which is formed of magnetic material and which includes a magnetic connecting part connected magnetically to one of the both end parts of the core of the antenna structure and a magnetism collecting part expanded in one side of the antenna structure from the magnetic connecting part to exclude the antenna structure, the magnetism collecting part covering the at least one magnetic drive unit in the one side to shut off magnetic flux of external magnetic field from the one side and collecting magnetic flux of radio wave on the one end part of the core of the antenna structure; and another external magnetic member which is formed of magnetic material and which includes a magnetic connecting part connected magnetically to the other of the both end parts of the core of the antenna structure and a magnetism collecting part expanded in the other side of the antenna structure from the magnetic connecting part to exclude the antenna structure, the magnetism collecting part covering the at least one magnetic drive unit in the other side to shut off magnetic flux of external magnetic field from the other side and collecting magnetic flux of radio wave on the other end part of the core of the antenna structure. And, the magnetism collecting part of the external magnetic member connected to the one of the both end parts of the core of the antenna structure through the magnetic connecting part and the magnetism collecting part of the another external magnetic member connected to the other one of the both end parts through the magnetic connecting part are faced each other with the at least one magnetic drive unit being disposed therebetween.

Additional objects and advantages of the invention will be set forth in the description which follows, and in part will be obvious from the description, or may be learned by practice of the invention. The objects and advantages of the invention may be realized and obtained by means of the instrumentalities and combinations partially pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, various radio wave controlled wrist watches each of which uses a radio wave receiving device with a magnetic drive unit and antenna structure, according to various embodiments of the present invention will be described with reference to the accompanying drawings.

First Embodiment

Figure 1:
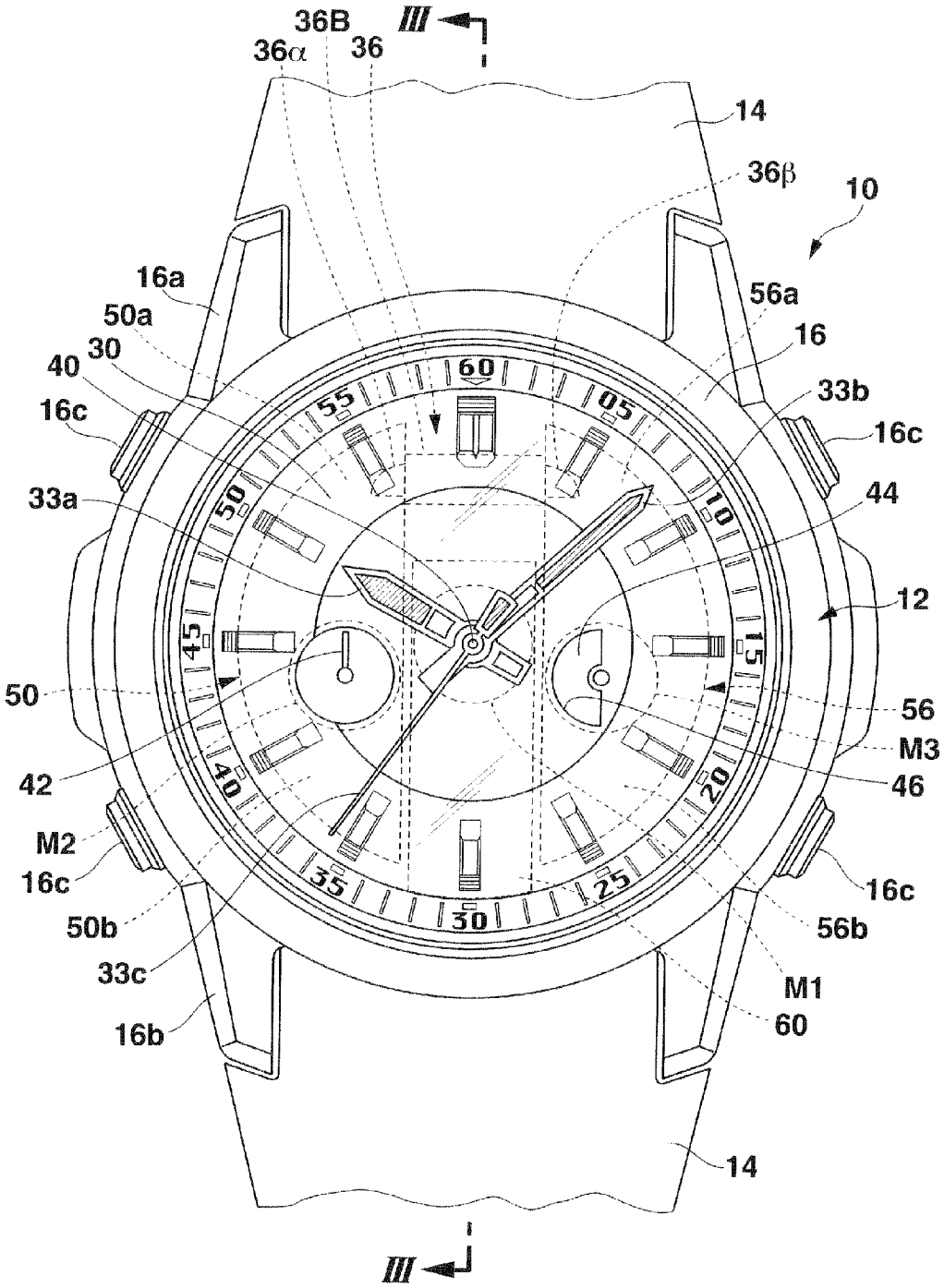
FIG. 1 is a plan view showing schematically a radio wave controlled wrist watch using a radio wave receiving device with a magnetic drive unit and an antenna structure, according to a first embodiment of the present invention.
Figure 2:
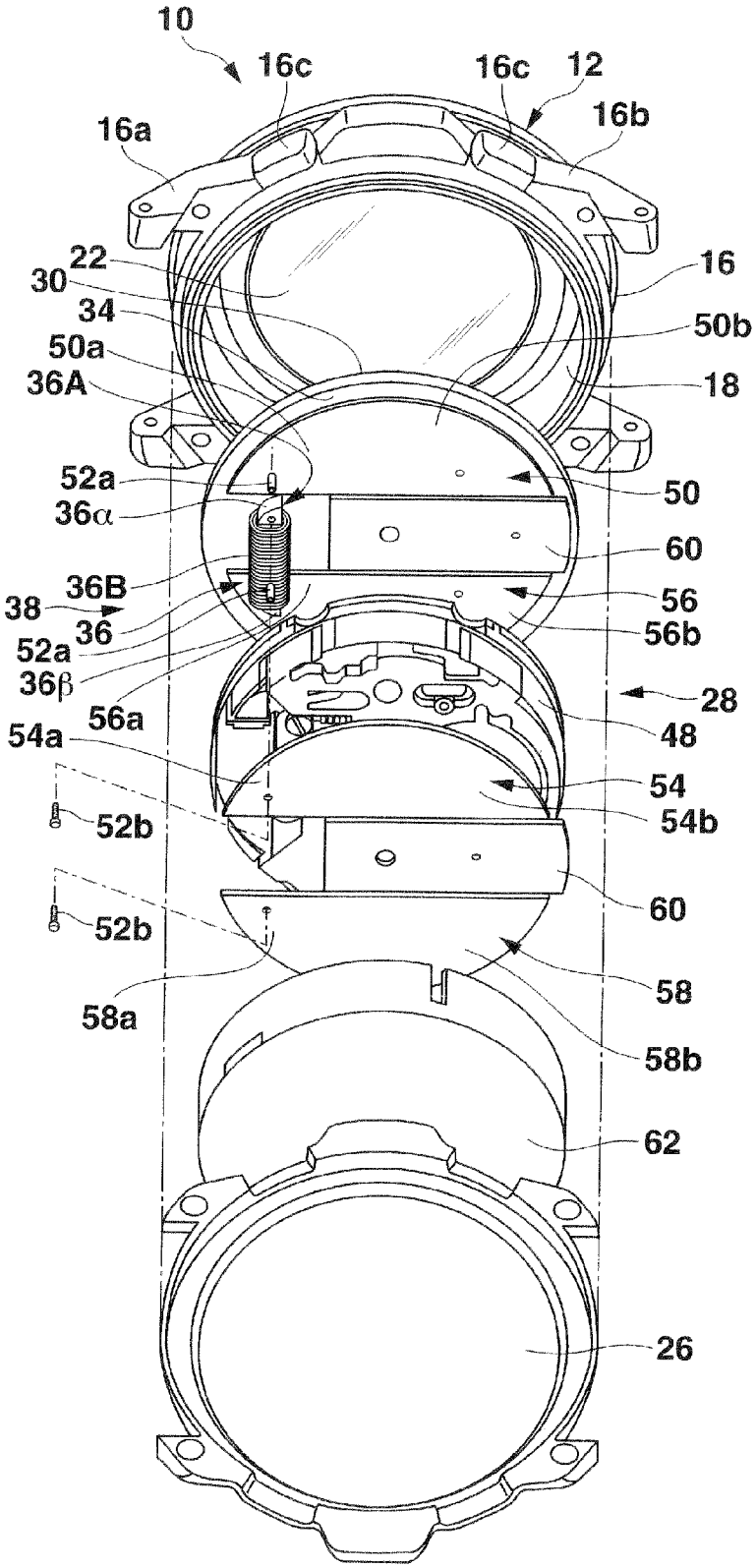
FIG. 2 is a schematic exploded perspective view of the radio wave controlled wrist watch of FIG. 1.
Figure 3:
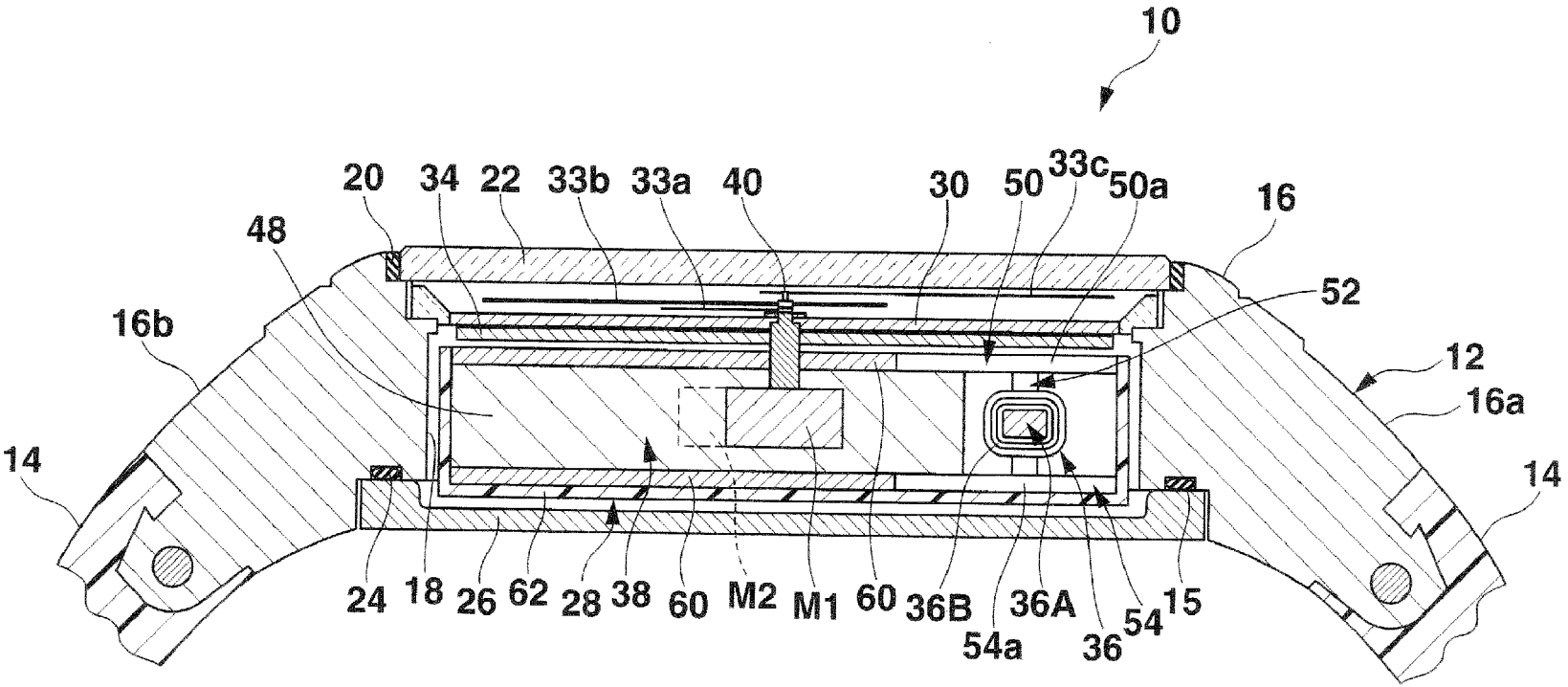
FIG. 3 is a schematic cross sectional view taken along the line III-III in FIG. 1.
Figure 4:
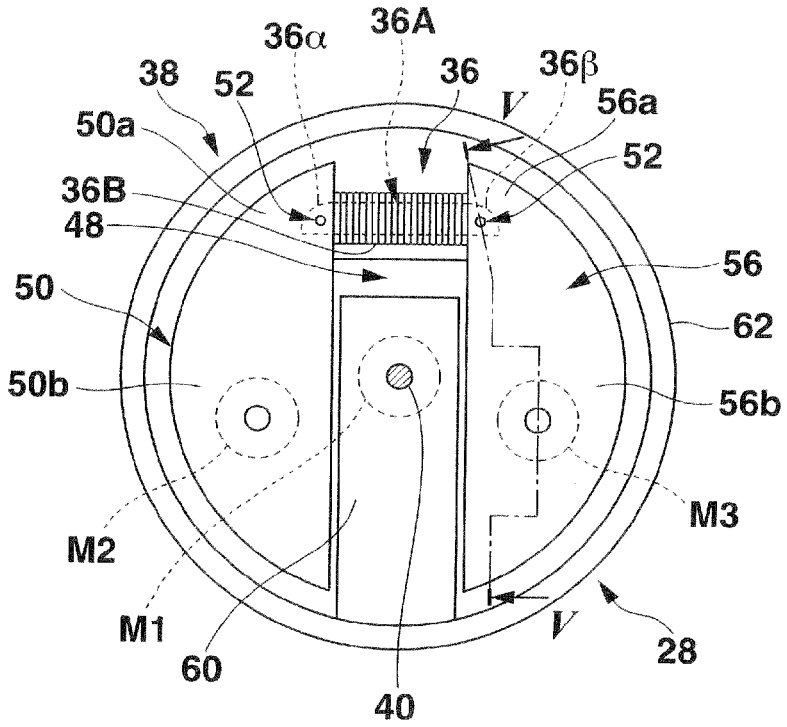
FIG. 4 is a schematic plan view of the radio wave receiving device with the magnetic drive unit and the antenna structure, according to the first embodiment of the present invention and used in the radio wave controlled time piece of FIG. 1.

As shown in FIGS. 1 to 3, an radio wave controlled wrist watches 10 using a radio wave receiving device with a magnetic drive unit and antenna structure, according to a first embodiment of the present invention comprises a box-like wrist watch main body 12 and a pair of watchbands 14 attached to two parts on opposite sides of the side surface of the wrist watch main body 12.

Specifically, the wrist watch main body 12 comprises a substantially cylindrical case 16. Two watchband attaching structures 16*a*, 16*b* for attaching the pair of watchbands 14 are provided on the two parts on the opposite sides of the side surfaces of the case 16. A plurality of switch buttons 16*c* are provided between the watchband attaching structures 16*a*, 16*b* on the side surfaces.

The case 16 includes an accommodation space 18 which communicates with external space through first and second openings formed in two flat surfaces of the case 16. The first opening of the case 16 is covered by a watch glass 22 with an annular packing 20. The watch glass 22 transmits not only light but also magnetic flux, and provides a light/magnetic flux transmitting lid. The second opening of the case 16 is covered by a back cover 26 with an O-ring 24. The case 16 and back cover 26 are formed of metal having corrosion resistance such as stainless steel, titanium, and the like. The back cover 26 has a smaller thickness than the case 16, transmits the magnetic flux although light is not permitted to pass through, and provides a magnetic flux transmitting lid.

A time piece module 28 is accommodated in the accommodation space 18 of the case 16 through the first or second opening. A dial plate 30 partitions the accommodation space 18 between the time piece module 28 and the watch glass 22, and an hour hand 33*a*, a minute hand 33*b* and a second hand 33*c* are disposed between the dial plate 30 and the watch glass 22 in the accommodation space 18. In this embodiment, each of the hour hand 33*a*, minute hand 33*b* and second hand 33*c* provides a time indicating hand.

The hour hand 33*a*, the minute hand 33*b* and the second hand 33*c* are driven by the time piece module 28 to indicate a current time on the dial plate 30.

The dial plate 30 is formed of material which transmits light and a solar panel 34 is attached to the rear surface of the dial plate 30.

The time piece module 28 includes a rechargeable battery (not shown) which is recharged by electric power generated by the solar panel 34, and this rechargeable battery supplies electric power to various electric power consuming elements which are included in the time piece module 28 and driven by electric power.

The time piece module 28 includes a radio wave receiving device 38 including plural motors M1, M2, M3 and an antenna structure 36 for receiving standard radio wave containing time information. Each of the motors M1, M2, M3 is the electric power consuming element and a magnetic drive unit which is driven by magnetism generated by consuming electric power.

In this embodiment, the motor M1 is located substantially at the center of the time piece module 28 and drives the hour hand 33*a*, the minute hand 33*b* and the second hand 33*c* through a time indicating hand drive shaft 40 penetrating substantially the center of the solar panel 42 and dial plate 30. In this embodiment, the motors M2 and M3 are disposed in both sides of the motor M1 in the time piece module 28.

The motor M2 drives an auxiliary time indicating hand 42 disposed between the dial plate 30 and the watch glass 22, through a drive shaft (not shown) penetrating the solar panel 34 and dial plate 30. The motor M3 drives an information indicating panel 44 disposed between the dial plate 30 and the motor M3, through a drive shaft (not shown) penetrating the solar panel 34 and the dial plate 30.

The information indicating panel 44 indicates information about, for example, the age of the moon, sea tide and day of the week, and an information display window 46 for reading information on the information indicating panel 44 is formed in the solar panel 34 and dial plate 30.

The time piece module 28 comprises an operation control circuit part 48 including various electronic circuit elements for the plural motors M1, M2, M3 and antenna structure 36. The various electronic circuit elements of the operation control circuit part 48, together with the plural motors M1, M2, M3, are arranged in a block by a supporting member (not shown) to match the shape of the accommodation space 18 of the case 16. The supporting member (not shown) is formed of nonmagnetic material such as synthetic resin.

The operation control circuit part 48 of the time piece module 28 is configured to perform various time piece functions including, for example, stopwatch function when it is operated by the various switch buttons 16*c* on the case 16.

The antenna structure 36 is disposed in a cutout part provided by the aforementioned block in the outer periphery of the time piece module 28.

The structure of the radio wave receiving device 38 which includes the antenna structure 36 and the plural motors M1, M2, M3 will be described more in detail with reference to FIGS. 1 to 5.

The antenna structure 36 includes a narrow core 36A formed of magnetic material such as amorphous metal, ferrite, permalloy, and the like, and a coil 36B wound around the central part of the core 36A. The core 36A may be a block of magnetic material as described above or a laminated body of plural thin plates of the magnetic material as described above.

Figure 5:
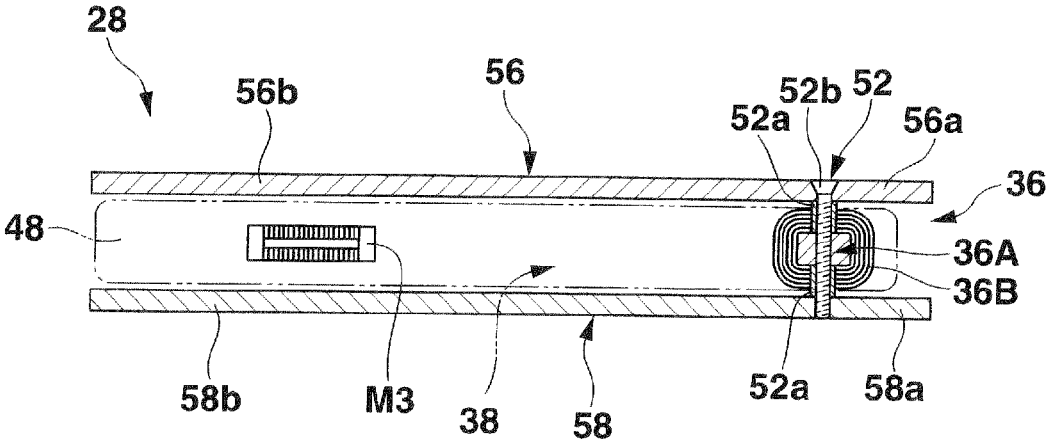
FIG. 5 is a schematic cross sectional view taken along the line V-V in FIG. 4.

In the radio wave receiving device 38 of this embodiment, a magnetic connecting part 50*a* of a thin-plate like first external magnetic member 50 formed of magnetic material such as amorphous metal, ferrite, permalloy, and the like is connected magnetically to one 36α of both end parts 36α, 36β of the core 36A of the antenna structure 36. Specifically, the first external magnetic member 50 of this embodiment is formed in a substantially half-moon shape, and one end part thereof is connected magnetically to the one end part 36α of the core 36A by a magnetic connecting element 52. The magnetic connecting element 52 is formed of magnetic material such as iron and the like, and provided in the form of a fixing pin or a fixing screw 52*b* with a pipe washer 52*a* as shown in FIG. 5.

The other part of the first external magnetic member 50 in the substantially half-moon shape excluding the magnetic connecting part 50*a* is expanded in one side of the time piece module 28 facing the dial plate 30 and watch glass 22 to exclude the antenna structure 36 and covers a substantially half part of the aforementioned one side. The watch glass 22 is the light/magnetic flux transmitting lid as described above, and the dial plate 30 with the solar panel 34 transmits light and magnetic flux. As a result, the aforementioned other part of the first external magnetic member 50 covers the motor M2 serving as at least one magnetic drive unit from the aforementioned one side to shut off magnetic flux of external magnetic field from the aforementioned one side, and functions as a magnetism collecting part 50*b* for collecting magnetic flux of radio wave on the one end part 36α of the core 36A of the antenna structure 36.

In the radio wave receiving device 38 according to this embodiment, a magnetic connecting part 54*a* of a thin-plate like second external magnetic member 54 formed of magnetic material such as amorphous metal, ferrite, permalloy, and the like is connected magnetically to the one end part 36α of the both end parts 36α, 36β of the core 36A of the antenna structure 36. Specifically, the second external magnetic member 54 according to this embodiment has a substantially half-moon shape like the first external magnetic member 50 described above, and one end part thereof, together with the magnetic connecting part 50*a* which is the one end part of the above-described first external magnetic member 50, is connected magnetically to the one end part 36α of the core 36A by the common magnetic connecting element 52.

The other part of the second external magnetic member 54 in the substantially half-moon shape excluding the magnetic connecting part 54*a* is expanded in the other side of the time piece module 28 facing the back cover 26 to exclude the antenna structure 36, and covers a substantially half part of the aforementioned other side. The back cover 26 is a magnetic flux transmitting lid as described above, and transmits magnetic flux. As a result, the aforementioned other part of the second external magnetic member 54 covers the motor M2 serving as the at least one magnetic drive unit from the aforementioned other side to shut off magnetic flux of external magnetic field from the other side, and functions as a magnetism collecting portion 54*b* for collecting magnetic flux of radio wave on the one end part 36α of the core 36A of the antenna structure 36.

That is, the first external magnetic member 50 and the second external magnetic member 54 cover respective substantially the half part of the one side of the time piece module 28 and that of the other side thereof excluding the antenna structure 36 with the motor M2 being disposed therebetween, thereby protecting an operation of the motor M2 from being influenced by external magnetic flux.

Although the back cover 26 is a magnetic flux transmitting lid in this embodiment, the second external magnetic member 54 may be omitted unless the back cover 26 transmits the external magnetic flux to such an extent that the operation of the motor M2 is affected.

In this embodiment, the second opening is formed in the other flat surface of the case 16 and the second opening is closed by the back cover 26. However, if no second opening is formed in the other flat surface of the case 16 and if the accommodation space 18 of the case 16 communicates with external space through only the first opening formed in the aforementioned one flat surface and closed by the watch glass 22 and if the back wall of the case 16 which provides the other flat surface does not transmit external magnetic flux to such an extent that the operation of the motor M2 is affected, the second external magnetic member 54 may be omitted.

In the radio wave receiving device 38 according to this embodiment, a magnetic connecting part 56*a* of a thin-plate like third external magnetic member 56 formed of magnetic material such as amorphous metal, ferrite, permalloy, and the like is connected magnetically to the other end part 36β of the both end parts 36α, 36β of the core 36A of the antenna structure 36. Specifically, the third external magnetic member 56 according to this embodiment is formed in a substantially half-moon shape symmetrical to that of the first external magnetic member 50, and one end part thereof is connected magnetically to the other end part 36β of the core 36A by the magnetic connecting element 52. The magnetic connecting element 52 is formed of magnetic material such as iron and provided in the form of the fixing screw 52*b* with the pipe washer 52*a* as shown in FIG. 5.

The other part of the third external magnetic member 56 in the substantially half-moon shape excluding the magnetic connecting part 56*a* is expanded in one side of the time piece module 28 facing the dial plate 30 and watch glass 22 to exclude the antenna structure 36, and covers a substantially half part of the aforementioned one side, symmetrical to the above-mentioned first external magnetic member 50. The watch glass 22 is the light/magnetic flux transmitting lid as described above, and the dial plate 30 with the solar panel 34 transmits light and magnetic flux. As a result, the aforementioned other part of the third external magnetic member 56 covers the motor M3 serving as at least one magnetic drive unit from the aforementioned one side to shut off magnetic flux of external magnetic field from the one side, and functions as a magnetism collecting part 56*b* for collecting magnetic flux of radio wave on the other end part 36β of the core 36A of the antenna structure 36.

In the radio wave receiving device 38 according to this embodiment, a magnetic connecting part 58*a* of a thin-plate like fourth external magnetic member 58 formed of magnetic material such as amorphous metal, ferrite, permalloy, and the like is connected magnetically to the other end part 36β of the both end parts 36α, 36β of the core 36A of the antenna structure 36. Specifically, the fourth external magnetic member 58 according to this embodiment is formed in a substantially half-moon shape like the third external magnetic member, 56 and one end part thereof, together with the magnetic connecting part 56*a* which is the one end part of the third external magnetic member 56, is connected magnetically to the other end part 36β of the core 36A by the common magnetic connecting element 52.

The other part of the fourth external magnetic member 58 in the substantially half-moon shape excluding the magnetic connecting part 58*a* is expanded in the other side of the time piece module 28 facing the back cover 26 to exclude the antenna structure 36, and covers a substantially half part of the other side symmetrical to the second external magnetic member 54 on the other side. The back cover 26 is the magnetic flux transmitting lid which transmits magnetic flux as described above. As a result, the aforementioned other part of the fourth external magnetic member 58 covers the motor M3 serving as the at least one magnetic drive unit from the other side to shut off magnetic flux of external magnetic field from the other side, and functions as a magnetism collecting part 58*b* for collecting magnetic flux of radio wave on the other end part 36β of the core 36A of the antenna structure 36.

That is, the third external magnetic member 56 covers substantially the half part of the one side of the time piece module 28, located symmetrically to the half part of the one side covered by the first external magnetic member 50, to exclude the antenna structure 36, and the fourth external magnetic member 58 covers substantially the half part of the other side of the time piece module 28, located symmetrically to the half part of the other side covered by the second external magnetic member 54, to exclude the antenna structure 36. Thus, the motor M3 is disposed between the third external magnetic member 56 and the fourth external magnetic member 58 to protect the operation of the motor M3 being influenced by the external magnetic flux.

In the radio wave receiving device 38 according to this embodiment, a gap is provided between the first external magnetic member 50 and the third external magnetic member 56 on the one side of the time piece module 28 excluding the antenna structure 36, and a width of the gap is substantially equal to the length of a central part of the core 36A of the antenna structure 36 on which the coil 36 is wound. And, a gap is provided between the second external magnetic member 54 and the fourth external magnetic member 58 on the other side of the time piece module 28 excluding the antenna structure 36, and a width of the gap is substantially equal to the length of the central part of the core 36A of the antenna structure 36 on which the coil 36 is wound.

The motor M1 which is one of the plural magnetic drive units of the radio wave receiving device 38 is located at the portion corresponding to the gap on each of the one side and other side of the time piece module 28.

A pair of antimagnetic plates 60 for shutting transmission of external magnetic flux is disposed in these gaps, and fixed to the supporting member (not shown) described previously of the time piece module 28 or to each other with the time piece module 28 sandwiched therebetween by any known fixing elements such as the fixing screws or fixing pins (not shown).

The pair of the antimagnetic plates 60 shut off influences of external magnetic flux on the motor M1.

The time piece module 28 which includes the operation control circuit part 48 with various electronic circuits in addition to the radio wave receiving device 38 with the antenna structure 36, the plural motors M1, M2, M3 as the various magnetic drive units, the first to fourth external magnetic members 50, 54, 56 and 58 and the additional antimagnetic plates 60, is housed in a cup-shaped protective case 62 having an external peripheral surface corresponding to the inner peripheral surface of the accommodation space 18 of the case 16. And, the protective case 62 with the time piece module 28 is accommodated in the accommodation space 18 of the case 16. The protective case 62 is made of non-magnetic material such as synthetic resin. A plurality of openings are formed at positions in the peripheral wall of the protective case 62 to correspond to the various switch buttons on the peripheral surface of the case 16. As a result, while the time piece module 28 housed in the protective case 62 is accommodated in the accommodation space 18 of the case 16, the various electronic circuit elements of the operation control circuit part 48 can be operated by the aforementioned various switch buttons.

Figure 6:
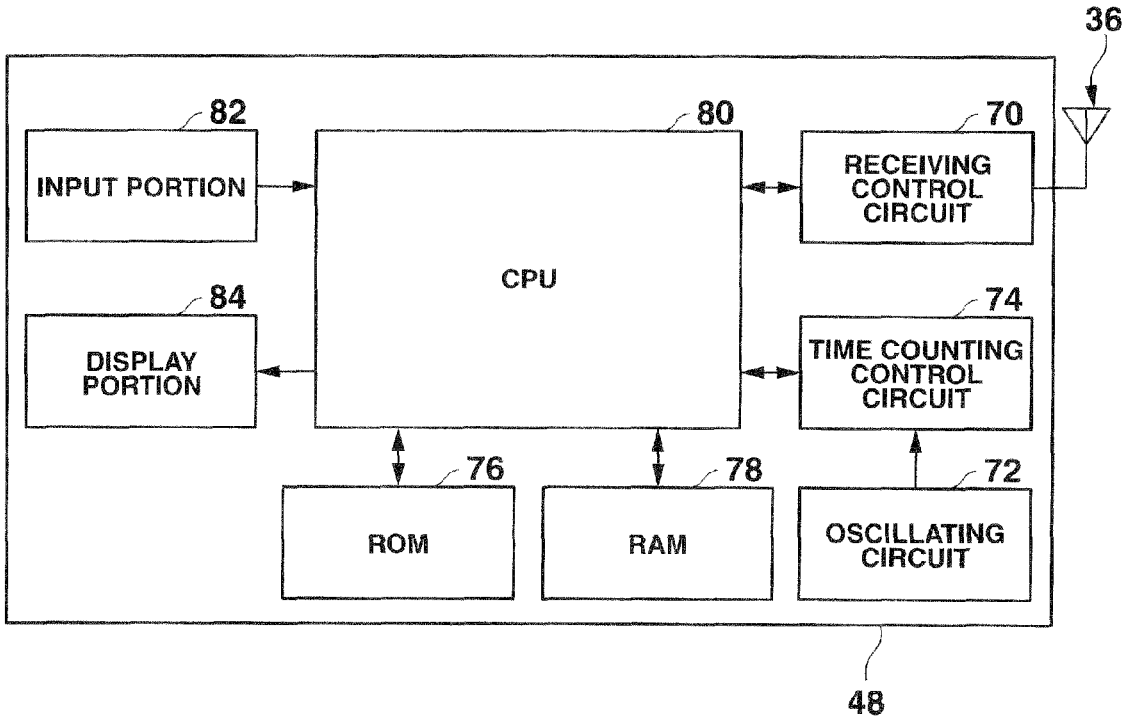
FIG. 6 is a schematic diagram of a structure of an operation control circuit part of the radio wave controlled wrist watch of FIG. 1.
Figure 7:
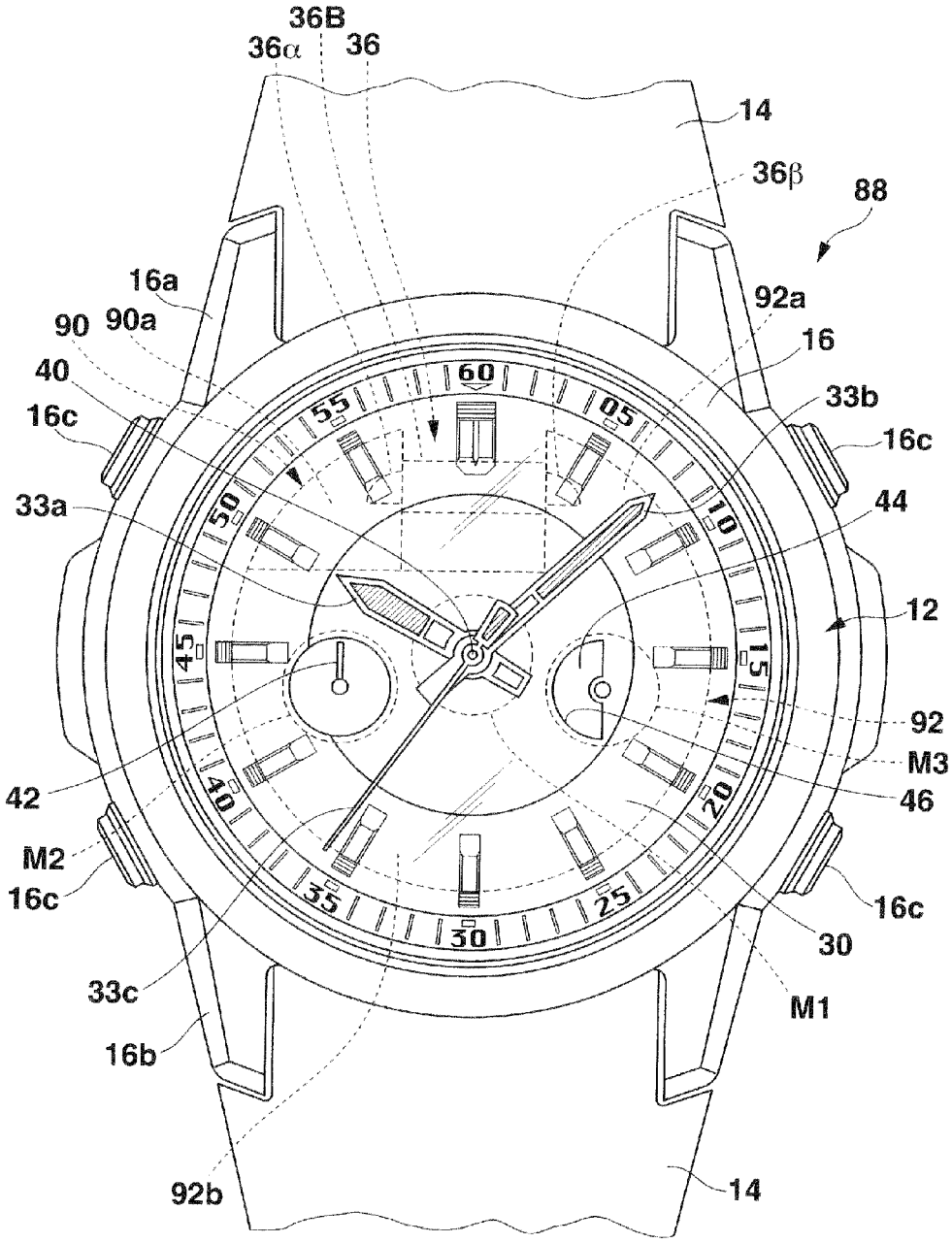
FIG. 7 is a schematic plan view of a radio wave controlled wrist watch with a magnetic drive unit and an antenna structure, according to a second embodiment of the present invention.
Figure 8:
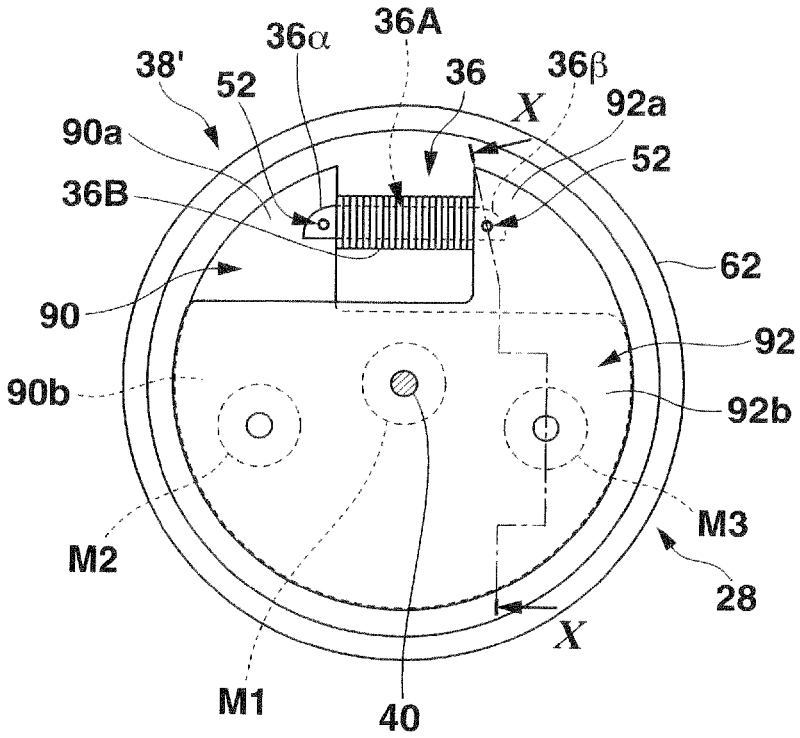
FIG. 8 is a schematic plan view of the radio wave receiving device with the magnetic drive unit and antenna structure, according to the second embodiment of the present invention and used in the radio wave controlled wrist watch of FIG. 7.
Figure 9:
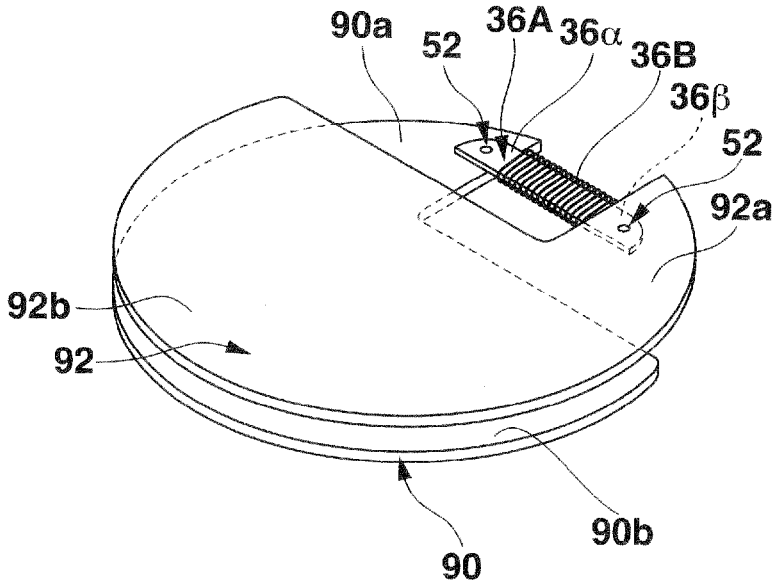
FIG. 9 is a schematic perspective view of the radio wave receiving device of FIG. 8.
Figure 10:
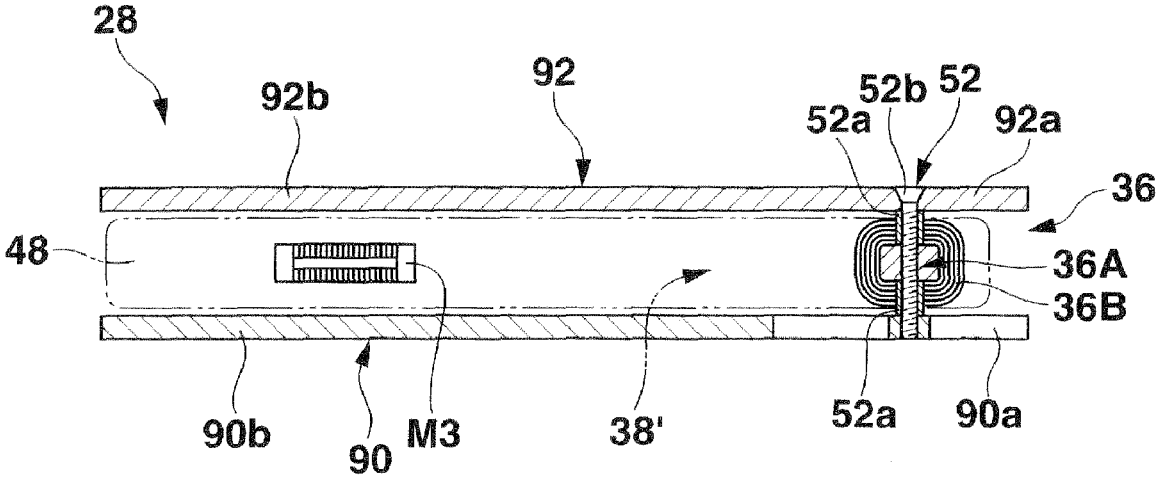
FIG. 10 is a schematic cross sectional view taken along the line X-X in FIG. 8.

FIG. 6 shows a schematic structure of the operation control circuit part 48.

The operation control circuit part 48 includes a receiving control circuit 70 connected to the antenna structure 36, an oscillating circuit 72, a time counting control circuit 74 connected to the oscillating circuit 72, a central processing unit (CPU) 80 having a read only memory (ROM) 76 and a random access memory (RAM) 78, an input portion 82 connected to the CPU 80 and a display portion 84 connected to the CPU 80. And, the receiving control circuit 70 and the time counting control circuit 74 are connected to the CPU 80.

In this embodiment, the input portion 82 includes various known switch elements (not shown) which are operated by the various switch buttons 16*c* on the external peripheral surface of the case 16. The display portion 84 includes: the motor M1 which drives the hour hand 33*a*, the minute hand 33*b* and the second hand 33*c* through the time indicating hand drive shaft 40 to indicate a time on the dial plate 30; the motor M2 which drives the auxiliary time indicating hand 42 to indicate auxiliary time (for example, a time in a smaller unit than the second) other than the times indicated by the hour hand 33*a*, the minute hand 33*b* and the second hand 33*c*; and the motor M3 which drives the information indicating panel 44 to indicate information about, for example, the age of the moon, sea tide, day of the week, and the like.

The CPU 80 reads out one of various programs stored in the ROM 76, based on a predetermining timing or a control signal inputted through the various known switch elements of the input portion 82, expands it in the RAM 78, gives predetermined instructions to the receiving control circuit 70, the time counting control circuit 74 and the display portion 84 in accordance with the read out program, and carries out a predetermined process on the basis of data supplied therefrom.

The time counting control circuit 74 calculates a current time from a clock signal having a predetermined constant frequency oscillated by the oscillating circuit 72, and provides current time data corresponding to the current time to the CPU 80. The CPU 80 drives the display portion 84 based on this current time data, and makes the motor M1 of the display portion 84 operate the hour hand 33*a*, the minute hand 33*b* and the second hand 33*c* through the time indicating hand drive shaft 40 to indicate the current time on the dial plate 30.

The receiving control circuit 70 picks up time information contained in the standard radio wave received through the antenna structure 36, every predetermined time or in accordance with an operation signal from the CPU 80 through the above described various switch buttons 16*c* of the input portion 82, and supplies the picked up time information to the CPU 80. The CPU 80 corrects the current time data provided from the time counting control circuit 74, based on this time information, drives the display portion 84 based on the corrected current time data, and then makes the motor M1 of the display portion 84 drive the hour hand 33*a*, the minute hand 33*b* and the second hand 33*c* through the time indicating hand drive shaft 40 to indicate the corrected current time on the dial plate 30.

The CPU 80 further reads out other program than the aforementioned program in the various programs stored in the ROM 76, based on operation signal inputted through the various known switch elements of the input portion 82, and expands it in the RAM 78, and then gives a predetermined instruction to the display portion 84 in accordance with this read out other program. The display portion 84 controls the operations of the motor M2 and/or the motor M3 in accordance with this predetermined instruction to indicate the auxiliary time (for example, a time in a smaller unit than the second) other than the time indicated on the dial plate 30 by the hour hand 33*a*, the minute hand 33*b* and the second hand 33*c* by the auxiliary time indicating hand 42, and/or to correct the information about, for example, the age of the moon, sea tide, day of the week, and the like, displayed through the information display window 46 of the dial plate 30 by the information indicating panel 44.

In the radio wave controlled wrist watch 10 configured as described above and using the radio wave receiving device 38 of the first embodiment of the present invention, the antenna structure 36 is accommodated in the accommodation space 18 of the case 16. However, the antenna structure 36 can receive the standard radio wave containing the time information through the first to fourth external magnetic members 50, 54, 56 and 58 in good condition even though the standard radio wave passes through the combination of the watch glass 22 (light/magnetic flux transmitting lid) closing the one side opening of the accommodation space 18 and the dial plate (light/magnetic flux transmitting lid) 30 having the solar panel (light/magnetic flux transmitting lid) 34 and passes through the back cover (magnetic flux transmitting lid) 26 closing the other side opening of the accommodation space 18 into the accommodation space 18.

That is, the receiving sensitivity of the antenna structure 36 to the standard radio wave can be improved largely.

Further, in the radio wave controlled time piece 10, each of the various motors M1, M2, M3 as the plural magnetic drive units accommodated, together with the antenna structure 36 and the first to fourth external magnetic members 50, 54, 56 and 58, in the accommodation space 18 of the case 16 are shielded from external magnetic flux by the first to fourth external magnetic members 50, 54, 56 and 58 and the pair of the antimagnetic plates 60 on the one side and the other side in the accommodation space 18, the one side facing the combination of the watch glass 22 (light/magnetic flux transmitting lid) closing the opening in the aforementioned one side of the accommodation space 18 and the dial plate 30 (light/magnetic flux transmitting lid) with the solar panel (light/magnetic flux transmitting lid) 34, and the other side facing the back cover (magnetic flux transmitting lid) 26 closing the other side opening of the accommodation space 18.

Consequently, the respective motors M1, M2 and M3 can be operated accurately without being affected by external magnetic flux.

If the back cover 26 closing the other side opening of the accommodation space 18 of the case 16 is formed of material which shuts off external magnetic flux to pass through or allows external magnetic flux to pass through in very low transmission factor or if the accommodation space 18 has no other side opening while the back wall opposed to the opening in the one side in the case 16 does not allow the external magnetic flux to pass through or has a very low transmission factor for the external magnetic flux, the second and fourth external magnetic members 54, 58 and other antimagnetic plate 60 directed to the opposite side to the opening in the aforementioned one side in the accommodation space 18 of the case 16 may be omitted.

Further, if the motor M2 which is the magnetic drive unit corresponding to the first external magnetic member 50 is not provided while the motor M3 which is the magnetic drive unit corresponding to the third external magnetic member 56 is provided, it is possible to omit the first external magnetic member 50 while only the third external magnetic member 56 is left. Conversely, if the motor M2 which is the magnetic drive unit corresponding to the first external magnetic member 50 is provided while the motor M3 which is the magnetic drive unit corresponding to the third external magnetic member 56 is not provided, it is possible to omit the third external magnetic member 56 while the first external magnetic member 50 is left.

The antimagnetic plate 60 in the aforementioned one opening side of the accommodation space 18 in the case 16 can be formed integrally with the first or third external magnetic member 50 or 56. Then, the antimagnetic plate 60 in the other opening side of the accommodation space 18 in the case 16 can be formed integrally with the second or fourth external magnetic member 54 or 58.

The magnetic connection of the magnetic connecting part 50*a* of the first external magnetic member 50 and that of the magnetic connecting part 54*a* of the second external magnetic member 54 to the one part 36α of the both end parts 36α, 36β of the core 36A of the antenna structure 36, and the magnetic connection of the magnetic connecting part 56*a* of the third external magnetic member 56 and that of the magnetic connecting part 58*a* of the fourth external magnetic member 58 to the other part 36β can be achieved by known conductive adhesive, conductive welding or pressure bonding.

Second Embodiment

Next, a radio wave controlled wrist watch 88 using a radio wave receiving device with a magnetic drive unit and an antenna structure, according to a second embodiment of the present invention will be described with reference to FIGS. 7 to 10.

Most part of the configuration of the radio wave controlled wrist watch 88 using the radio wave receiving device according to the second embodiment is the same as that of the configuration of the radio wave controlled wrist watch 10 using the radio wave receiving device 38 according to the first embodiment of the present invention described above with reference to FIGS. 1 to 6. Thus, the same components of the radio wave controlled wrist watch 88 as those of the radio wave controlled wrist watch 10 are indicated by the same reference numerals as those indicating the corresponding components of the radio wave controlled wrist watch 10, and detailed descriptions thereof are omitted.

A radio wave receiving device 38' according to this embodiment is different from the radio wave receiving device 38 according to the first embodiment described with reference to FIGS. 1 to 6 in that only one external magnetic member (first external magnetic member in this embodiment) 90 is connected magnetically to the one end part 36α of the both end parts 36α, 36β of the core 36A of the antenna structure 36; only one external magnetic member (second external magnetic member in this embodiment) 92 is connected magnetically to the other end part 36β of the core 36A; and in the respective shapes of the first and second external magnetic members 90 and 92.

Specifically, the first external magnetic member 90 is formed of a thin plate of magnetic material such as amorphous metal, ferrite, permalloy, and the like, and includes a magnetic connecting part 90*a* connected magnetically to the one end part 36α of the core 36A by a magnetic connecting element 52, and a magnetism collecting part 90*b* expanded along the one side (in this embodiment, facing the back cover 26 shielding the other side opening of the accommodation space 18 of the case 16) of the operation control circuit part 48 of the time piece module 28 to exclude the antenna structure 36. The magnetism collecting part 90*b* covers the three motors M1, M2, M3 which are the plural magnetic drive units of the time piece module 28 in the aforementioned one side.

The second external magnetic member 92 is formed of a thin plate of magnetic material such as amorphous metal, ferrite, permalloy, and the like, and includes a magnetic connecting part 92*a* connected magnetically to the other end part 36β of the core 36A by the magnetic connecting element 52 and a magnetism collecting part 92*b* expanded along the other side (in this embodiment, facing the watch glass 22 and the dial plate 30 with the solar panel 34 which shield the opening in the one side of the accommodation space 18 of the case 16) of the operation control circuit part 48 of the time piece module 28 to exclude the antenna structure 36. The magnetism collecting part 92*b* covers the plural magnetic drive units of the time piece module 28, i.e., the three motors M1, M2, M3, in the aforementioned other side. That is, the magnetism collecting part 92*b* of the second external magnetic member 92 faces the magnetism collecting part 90*b* of the first external magnetic member 90 such that the operation control circuit part 48 and the plural magnetic drive units, i.e., the three motors M1, M2, M3, are disposed therebetween.

In the radio wave controlled wrist watch 88 using the radio wave receiving device 38' according to the second embodiment, and configured as described above, the antenna structure 36 is accommodated in the accommodation space 18 of the case 16. However, the antenna structure 36 can receive the standard radio wave containing the time information through the first and second external magnetic members 90, 92 in a very good condition, even the standard radio wave passes through the combination of the watch glass 22 (light/magnetic flux transmitting lid) closing the one side opening of the accommodation space 18 and the dial plate (light/magnetic flux transmitting lid) 30 with the solar panel 34 and passes through the back cover (magnetic flux transmitting lid) 26 closing the other side opening of the accommodation space 18, into the accommodation space 18.

That is, the receiving sensitivity of the antenna structure 36 to the standard radio wave can be improved largely.

Further, in the radio wave controlled wrist watch 88, the various motors M1, M2, M3 as the plural magnetic drive units, together with the antenna structure 36 and the first and second external magnetic members 90, 92, accommodated in the accommodation space 18 of the case 16 are shielded from external magnetic flux on the one side and the other side in the accommodation space 18 by the first and second external magnetic members 90, 92, the one side facing the combination of the watch glass 22 (light/magnetic flux transmitting lid) closing the opening in the aforementioned one side of the accommodation space 18 and the dial plate (light/magnetic flux transmitting lid) 30 with the solar panel (light/magnetic flux transmitting lid) 34, and the other side facing the back cover (magnetic flux transmitting lid) 26 closing the other side opening of the accommodation space 18.

Consequently, the respective motors M1, M2 and M3 can be operated accurately without being affected by external magnetic flux.

If the back cover 26 closing the other side opening of the accommodation space 18 of the case 16 is formed of material which shuts off external magnetic flux or which has a very low transmission factor for external magnetic flux, or if the accommodation space 18 has no other side opening while the back wall opposed to the opening in the one side does not allow the external magnetic flux to pass through or has a very low transmission factor for the external magnetic flux, the second external magnetic member 92 directed to the side opposing to the opening in the aforementioned one side in the accommodation space 18 of the case 16 may be omitted.

In this embodiment, the first external magnetic member 90 connected magnetically to the one end part 36α of the core 36A of the antenna structure 36 through the magnetic connecting part 90*a* is disposed in the other side (in this embodiment, facing the back cover 26 which shields the other side opening of the accommodation space 18 of the case 16) of the operation control circuit part 48 of the time piece module 28. And, the second external magnetic member 92 connected magnetically to the other end part 36β of the core 36A through the magnetic connecting part 92*a* is disposed in one side (in this embodiment, facing the watch glass 22 shielding the opening in the one side of the accommodation space 18 of the case 16 and the decorative panel 30 with the solar panel 34) of the operation control circuit part 48 of the time piece module 28.

However, according to the concept of the present invention, contrarily to the above described embodiment, it is possible to dispose the first external magnetic member 90 in the one side (in this embodiment, facing the watch glass 22 shielding the opening in the one side of the accommodation space 18 of the case 16 and the decorative panel 30 with the solar panel 34) of the operation control circuit part 48 of the time piece module 28, and to dispose the second external magnetic member 92 in the other side (in this embodiment, facing the back cover 26 shielding the opening in the other side of the accommodation space 18 of the case 16) of the operation control circuit part 48 of the time piece module 28.

The magnetic connection of the magnetic connecting part 90*a* of the first external magnetic member 90 to the one end part 36α of the both end parts 36α, 36β of the core 36A of the antenna structure 36 and magnetic connection of the magnetic connecting part 92*a* of the second external magnetic member 92 to the other end part 36β can be achieved by known conductive adhesive, conductive welding or pressure bonding.

In the above description, the radio wave receiving devices 38, 38' according to the first and second embodiments of the present invention are used in the radio wave controlled wrist watches 10, 88 as electronic apparatuses. But, the radio wave receiving device with at least one magnetic drive unit and an antenna structure, according to the concept of the present invention can be used in any electronic apparatus using such a radio wave receiving device.

As such an electronic apparatus, a mobile phone with an auto-focus camera, a mobile game machine with an auto-focus camera and a digital storage medium playback device having TV and/or radio function can be exemplified. Each of the mobile phone with an auto-focus camera and the mobile game machine with an auto-focus camera employs a motor serving as a magnetic drive unit to drive an auto-focus mechanism. The mobile game machine having an auto-focus camera employs an antenna structure for wireless LAN (local area network). Further, the digital storage medium playback device having TV and/or radio function employs an antenna structure for receiving TV waves and/or radio waves and a motor as a magnetic drive unit for driving such a digital storage medium as CD or DVD.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A radio wave receiving device comprising:

at least one magnetic drive unit;

an antenna structure which includes a narrow core formed of magnetic material and having both end parts and a central part between the both end parts, and a coil wound around the central part of the core;

an external magnetic member which is formed of magnetic material, and which includes a magnetic connecting part connected magnetically to one of the both end parts of the core of the antenna structure and a magnetism collecting part expanded in one side of the antenna structure from the magnetic connecting part to exclude the antenna structure, the magnetism collecting part covering the at least one magnetic drive unit in the one side to shut off magnetic flux of external magnetic field from the one side and collecting magnetic flux of radio wave on the one end part of the core of the antenna structure; and another external magnetic member which is formed of magnetic material and which includes a magnetic connecting part connected magnetically to the one of the both end parts of the core of the antenna structure and a magnetism collecting part expanded in the other side of the antenna structure from the magnetic connecting part to exclude the antenna structure, the magnetism collecting part covering the at least one magnetic drive unit in the other side to shut off magnetic flux of external magnetic field from the other side and collecting magnetic flux of radio wave on the one end part of the core of the antenna structure.

2. The radio wave receiving device according to claim 1, further comprising another external magnetic member which is formed of magnetic material and which includes a magnetic connecting part connected magnetically to the other one of the both end parts of the core of the antenna structure and a magnetism collecting part expanded in the one side of the antenna structure from the magnetic connecting part to exclude the antenna structure and to shut off magnetic flux of external magnetic field from the one side and collecting magnetic flux of radio on the other end part of the core of the antenna structure.

3. The radio wave receiving device according to claim 2, further comprising:

at least another magnetic drive unit which is covered from the one side by the another external magnetic member connected magnetically to the other one of the both end parts of the core of the antenna structure to shut off magnetic flux of external magnetic field from the one side; and a further external magnetic member which is formed of magnetic material and which includes a magnetic connecting part connected magnetically to the other one of the both end parts of the core of the antenna structure and a magnetism collecting part expanded in the other side of the antenna structure from the magnetic connecting part to exclude the antenna structure, the further external magnetic member covering the at least another magnetic drive unit from the other side to shut off magnetic flux of external magnetic field from the other side and collecting magnetic flux of radio wave on the other end part of the core of the antenna structure.

4. An electronic apparatus comprising:

a case which includes an accommodation space at least a part of which is opened;

the radio wave receiving device of claim 1 which is accommodated in the accommodation space of the case through the opening; and a magnetic flux transmitting lid which covers the opening, wherein the external magnetic member on the one side of the radio wave receiving device faces the magnetic flux transmitting lid.

5. The electronic apparatus according to claim 4, wherein the radio wave receiving device further comprises another external magnetic member which is formed of magnetic material and which includes a magnetic connecting part connected magnetically to the other one of the both end parts of the core of the antenna structure and a magnetism collecting part expanded in the one side of the antenna structure from the magnetic connecting part to exclude the antenna structure and to shut off magnetic flux of external magnetic field from the one side and collecting magnetic flux of radio wave on the other end part of the core of the antenna structure.

6. The electronic apparatus according to claim 5, wherein the radio wave receiving device further comprises:

at least another magnetic drive unit which is covered from the one side by the another external magnetic member connected magnetically to the other one of the both end parts of the core of the antenna structure to shut off magnetic flux of external magnetic field from the one side; and a further external magnetic member which is formed of magnetic material and which includes a magnetic connecting part connected magnetically to the other one of the both end parts of the core of the antenna structure and a magnetism collecting part expanded in the other side of the antenna structure from the magnetic connecting part to exclude the antenna structure, the further external magnetic member covering the at least another magnetic drive unit from the other side to shut off magnetic flux of external magnetic field from the other side and collecting magnetic flux of radio wave on the other end part of the core of the antenna structure.

7. The electronic apparatus according to claim 4, wherein the magnetic drive unit of the radio wave receiving device includes a motor, the antenna structure of the radio wave receiving device receives standard radio wave containing time information, and the magnetic flux transmitting lid transmits light, the electronic apparatus further comprising:

a partition plate which is disposed in the accommodation space of the case to partition the accommodation space between the magnetic flux transmitting lid and the radio wave receiving device;

at least one time indicating hand which is disposed between the magnetic flux transmitting lid and the partition plate in the accommodation space of the case and which is driven by the motor to indicate a time on the partition plate; and an operation control circuit part which, together with the radio wave receiving device, is accommodated in the accommodation space of the case to control the operation of the motor to make the at least one time indicating hand indicate a current time on the partition plate and which drives the motor based on time information in the standard radio wave received by the antenna structure to correct the current time indicated on the partition plate by the at least one time indicating hand.

8. The electronic apparatus according to claim 7 wherein the radio wave receiving device further comprises another external magnetic member which is formed of magnetic material and which includes a magnetic connecting part connected magnetically to the other one of the both end parts of the core of the antenna structure and a magnetism collecting part expanded in the one side of the antenna structure from the magnetic connecting part to exclude the antenna structure and to shut off magnetic flux of external magnetic field from the one side and collecting magnetic flux of radio wave on the other end part of the core of the antenna structure.

9. The electronic apparatus according to claim 8, wherein the radio wave receiving device further comprises:

at least another magnetic drive unit which is covered from the one side by the another external magnetic member connected magnetically to the other one of the both end parts of the core of the antenna structure to shut off magnetic flux of external magnetic field from the one side; and a further external magnetic member which is formed of magnetic material and which includes a magnetic connecting part connected magnetically to the other one of the both end parts of the core of the antenna structure and a magnetism collecting part expanded in the other side of the antenna structure from the magnetic connecting part to exclude the antenna structure, the further external magnetic member covering the at least another magnetic drive unit from the other side to shut off magnetic flux of external magnetic field from the other side and collecting magnetic flux of radio wave on the other end part of the core of the antenna structure.

10. The electronic apparatus according to claim 7, wherein the case has another opening in a side being opposite to the at least one opening, and the electronic apparatus further comprising another magnetic flux transmitting lid which is attached detachably to the another opening of the case to cover the another opening.

11. The electronic apparatus according to claim 10, wherein the radio wave receiving device further comprises another external magnetic member which is formed of magnetic material and which includes a magnetic connecting part connected magnetically to the other one of the both end parts of the core of the antenna structure and a magnetism collecting part expanded in the one side of the antenna structure from the magnetic connecting part to exclude the antenna structure and to shut off magnetic flux of external magnetic field from the one side and collecting magnetic flux of radio wave on the other end part of the core of the antenna structure.

12. The electronic apparatus according to claim 11, wherein the radio wave receiving device further comprises:

at least another magnetic drive unit which is covered from the one side by the another external magnetic member connected magnetically to the other one of the both end parts of the core of the antenna structure to shut off magnetic flux of external magnetic field from the one side; and a further external magnetic member which is formed of magnetic material and which includes a magnetic connecting part connected magnetically to the other one of the both end parts of the core of the antenna structure and a magnetism collecting part expanded in the other side of the antenna structure from the magnetic connecting part to exclude the antenna structure, the further external magnetic member covering the at least another magnetic drive unit from the other side to shut off magnetic flux of external magnetic field from the other side and collecting magnetic flux of radio wave on the other end part of the core of the antenna structure.

13. A radio wave receiving device comprising:

at least one magnetic drive unit;

an antenna structure which includes a narrow core formed of magnetic material and having both end parts and a central part between the both end parts, and a coil wound around the central part of the core;

an external magnetic member which is formed of magnetic material and which includes a magnetic connecting part connected magnetically to one of the both end parts of the core of the antenna structure and a magnetism collecting part expanded in one side of the antenna structure from the magnetic connecting part to exclude the antenna structure, the magnetism collecting part covering the at least one magnetic drive unit in the one side to shut off magnetic flux of external magnetic field from the one side and collecting magnetic flux of radio wave on the one end part of the core of the antenna structure; and another external magnetic member which is formed of magnetic material and which includes a magnetic connecting part connected magnetically to the other of the both end parts of the core of the antenna structure and a magnetism collecting part expanded in the other side of the antenna structure from the magnetic connecting part to exclude the antenna structure, the magnetism collecting part covering the at least one magnetic drive unit in the other side to shut off magnetic flux of external magnetic field from the other side and collecting magnetic flux of radio wave on the other end part of the core of the antenna structure, wherein the magnetism collecting part of the external magnetic member connected to the one of the both end parts of the core of the antenna structure through the magnetic connecting part and the magnetism collecting part of the another external magnetic member connected to the other one of the both end parts through the magnetic connecting part are faced each other with the at least one magnetic drive unit being disposed therebetween.

14. The radio wave receiving device according to claim 13, further comprising a plurality of magnetic drive units, wherein the external magnetic member connected to the one of the both end parts of the core of the antenna structure through the magnetic connecting part and the another external magnetic member connected to the other of the both end parts of the core through the magnetic connecting part face each other with the plurality of magnetic drive units being disposed therebetween.

15. An electronic apparatus comprising:

a case which includes an accommodation space at least a part of which is opened;

the radio wave receiving device of claim 13 which is accommodated in the accommodation space of the case through the opening; and a magnetic flux transmitting lid which covers the opening, wherein the external magnetic member on the one side of the radio wave receiving device faces the magnetic flux transmitting lid.

16. The electronic apparatus according to claim 15, further comprising a plurality of magnetic drive units, wherein the external magnetic member connected to the one of the both end parts of the core of the antenna structure through the magnetic connecting part and the another external magnetic member connected to the other of the both end parts of the core through the magnetic connecting part face each other with the plurality of magnetic drive units being disposed therebetween.

17. The electronic apparatus according to claim 15, wherein the magnetic drive unit of the radio wave receiving device includes a motor, the antenna structure of the radio wave receiving device receives standard radio wave containing time information, and the magnetic flux transmitting lid transmits light, the electronic apparatus further comprising:

a partition plate which is disposed in the accommodation space of the case to partition the accommodation space between the magnetic flux transmitting lid and the radio wave receiving device;

at least one time indicating hand which is disposed between the magnetic flux transmitting lid and the partition plate in the accommodation space of the case and which is driven by the motor to indicate a time on the partition plate; and an operation control circuit part which, together with the radio wave receiving device, is accommodated in the accommodation space of the case to control the operation of the motor to make the at least one time indicating hand indicate a current time on the partition plate and which drives the motor based on time information in the standard radio wave received by the antenna structure to correct the current time indicated on the partition plate by the at least one time indicating hand.

18. The electronic apparatus according to claim 17, further comprising a plurality of magnetic drive units, wherein the external magnetic member connected to the one of the both end parts of the core of the antenna structure through the magnetic connecting part and the another external magnetic member connected to the other of the both end parts of the core through the magnetic connecting part face each other with the plurality of magnetic drive units being disposed therebetween.

19. The electronic apparatus according to claim 17, wherein the case has another opening in a side being opposite to the at least one opening, and the electronic apparatus further comprising another magnetic flux transmitting lid which is attached detachably to the another opening of the case to cover the another opening.

20. The electronic apparatus according to claim 19, further comprising a plurality of magnetic drive units, wherein the external magnetic member connected to the one of the both end parts of the core of the antenna structure through the magnetic connecting part and the another external magnetic member connected to the other of the both end parts of the core through the magnetic connecting part face each other with the plurality of magnetic drive units being disposed therebetween.

* * * * *